US008248430B2

(12) United States Patent
Hekstra et al.

(10) Patent No.: US 8,248,430 B2
(45) Date of Patent: Aug. 21, 2012

(54) MULTI-PRIMARY CONVERSION

(75) Inventors: Gerben Johan Hekstra, Eindhoven (NL); Michiel Adriaanszoon Klompenhouwer, Eindhoven (NL)

(73) Assignee: TP Vision Holding B.V., Eindhoven (NL)

( * ) Notice: Subject to any disclaimer, the term of this patent is extended or adjusted under 35 U.S.C. 154(b) by 582 days.

(21) Appl. No.: 12/445,476

(22) PCT Filed: Oct. 17, 2007

(86) PCT No.: PCT/IB2007/054224

§ 371 (c)(1),
(2), (4) Date: Apr. 14, 2009

(87) PCT Pub. No.: WO2008/047313

PCT Pub. Date: Apr. 24, 2008

(65) Prior Publication Data

US 2010/0013848 A1 Jan. 21, 2010

(30) Foreign Application Priority Data

Oct. 19, 2006 (EP) ..... 06122574

(51) Int. Cl.
*G09G 5/02* (2006.01)
*G09G 5/10* (2006.01)

(52) U.S. Cl. ..... 345/589; 345/590; 345/604; 345/690

(58) Field of Classification Search ..... None
See application file for complete search history.

(56) References Cited

U.S. PATENT DOCUMENTS

2005/0083352 A1* 4/2005 Higgins ..... 345/690
2009/0058873 A1* 3/2009 Brown Elliott et al. ..... 345/589

FOREIGN PATENT DOCUMENTS

EP 1388818 A2 2/2004
WO 02091349 A1 11/2002
WO 2006106457 A1 10/2006

* cited by examiner

*Primary Examiner* — Kee M Tung
*Assistant Examiner* — Sing-Wai Wu
(74) *Attorney, Agent, or Firm* — Shimokaji & Assoc., PC

(57) ABSTRACT

A method converts an input image signal (IS) into a drive signal (DS) for driving sub-pixels (SP) of a display device (DD) comprising display pixels (DPI) having at least two sub-pixel groups (SG1, SG2) being able to contribute to luminance information displayed. The conversion comprises a multi-primary conversion (MPC) which receives the input image signal (IS) and which is performed under a constraint (CO). The constraint (CO) is determined (CD) by substantially matching local display luminances (DL1, DL2; DLD) associated with the at least two sub-pixel groups (SG1, SG2) with corresponding local input luminances (L1, L2; LD) of input pixels (IP) of the input image signal (IS), thereby obtaining a display luminance pattern defined by the display pixels (DPI) corresponding to an input luminance pattern defined by the input pixels (IP) associated with the display pixels (DPI).

11 Claims, 5 Drawing Sheets

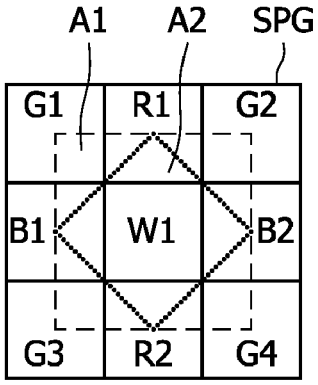
FIG. 3A
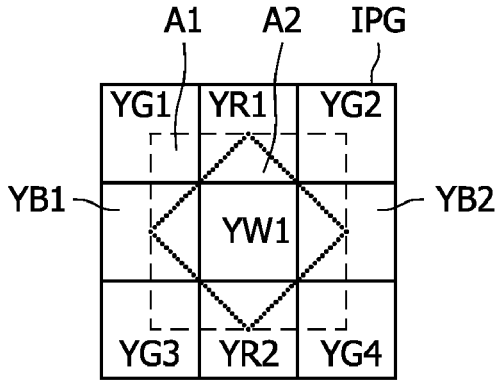
FIG. 3B
| | | |
|---|---|---|
| 1/4 | 1/4 | 1/4 |
| 1/4 | 0 | 1/4 |
| 1/4 | 1/4 | 1/4 |
FIG. 3C
| | | |
|---|---|---|
| 0 | 1/4 | 0 |
| 1/4 | 1 | 1/4 |
| 0 | 1/4 | 0 |
FIG. 3D

MULTI-PRIMARY CONVERSION

FIELD OF THE INVENTION

The invention relates to a conversion of an input image signal into a drive signal for driving sub-pixels of a display device, a conversion unit for converting an input image signal into a drive signal for driving sub-pixels of a display device, and a related computer program product.

The invention is for example useful in large matrix displays like for example LCD displays and in mobile displays used in mobile phones, personal digital assistants, personal media players, digital still cameras and digital camcorders.

BACKGROUND OF THE INVENTION

Increasing the pixel resolution of small RGB displays causes a severe loss in aperture and consequently brightness. The implementation of a multi-primary sub-pixel layout of the pixels of the display together with sub-pixel rendering allows the use of larger sub-pixels and increased transmission through the color filters, and hence an increased brightness without much influence on the perceived resolution. A reduction of the pixel resolution by using a multi-primary display and application of sub-pixel rendering enables to use less drivers.

For full color reproduction, a multi-primary display is a display with more than the three standard primaries, which usually are red R, green G, and blue B. An example of a multi-primary display is an RGBW display of which the pixels comprise R, G, B and white W sub-pixels. In such an RGBW display, the transmission of light through the pixel is greatly increased because no color filter is required for the W sub-pixel. However, the gamut is reduced because this W sub-pixel can not be activated for high brightness saturated colors. A second advantage is the increased resolution through sub-pixel rendering.

Some examples of known sub-pixel configurations of RGBW displays are the quad pixel configuration, the pentile configuration and the vertical stripe configuration. Examples of other existing multi-primary displays are RGBY displays wherein one of the sub-pixels is yellow Y, or RGBCY displays in which the pixels comprise additional cyan C and yellow Y sub-pixels.

The basic reason why sub-pixel rendering increases the resolution is that each sub-pixel is able to convey luminance information at a higher resolution than the full pixel. The effectiveness of sub-pixel rendering for a particular sub-pixel configuration is strongly influenced by how many luminance points can be assigned to each pixel, and how strong these luminance points are. With strong is meant the maximum luminance reachable and having a more similar color. In an RGBW display the two luminance points W and RGB are very strong, both the first group of sub-pixels which comprises the W sub-pixel and the second group of sub-pixels which comprises the R, G, and B sub-pixels are able to produce the same white light with a high intensity. Further, the luminance of the W sub-pixel may be very high.

A state of the art video chain for sub-pixel rendering may comprise a scaling unit, a pre-filter, a multi-primary conversion and a sub-pixel mapping. The scaling unit receives an RGB image with arbitrary resolution and supplies an RGB image at full resolution matching the luminance points resolution of the display. Or said differently, in the full resolution RGB image an RGB sample exists for each sub-pixel of the display. The image may be a still image or video, and may comprise synthetic and/or natural information. The synthetic information may be computer generated information such as, for example, text and/or graphs. The natural information may be, for example, a photograph or film. Preferably, the input image has image detail that corresponds to what can be represented by the luminance points of the display. The pre-filter filters the RGB full resolution image to remove (chroma) detail which cannot be represented by the sub-pixel rendering without visible artifacts. Thus, detail is lost, but color and luminance are maintained. The multi-primary converter converts the filtered RGB signal into a full resolution RGBW signal. Or, more general, converts the three primary input signal into the multi-primary signals associated with the more than three sub-pixels per pixel of the display. The sub-pixel mapper generates the drive values for the sub-pixels by selecting them from the full resolution RGBW signal depending on the primary dictated by the sub-pixel pattern for the location of the sub-pixel. However, such existing sub-pixel rendering algorithm has the drawback that the readability of text, and the representation of fine details and datagraphic images is poor.

SUMMARY OF THE INVENTION

It is an object of the invention to improve the readability of text, or the representation of fine details or of datagraphic images.

A first aspect of the invention provides a conversion as claimed in claim 1. A second aspect of the invention provides a conversion unit as claimed in claim 11. A third aspect of the invention provides a computer program product as claimed in claim 12. Advantageous embodiments are defined in the dependent claims.

A conversion in accordance with the first aspect of the invention converts an input image signal into an output signal for driving sub-pixels of a display device. As generally known, a multi-primary conversion converts the input signal defined by M input primaries into the output signal defined by N>M display primaries. Both M and N are positive integers. Usually, the N display primaries are associated with N sub-pixels which convey differently colored light. The sub-pixels may generate the light or may transmit or reflect the light. The display device comprises display pixels which have at least two sub-pixel groups able to substantially contribute to luminance information displayed. In the example of an RGBW display the two groups may be the RGB sub-pixels or primaries and the W sub-pixel or primary. Alternatively the two groups may be the G sub-pixels and the W sub-pixels.

The multi-primary conversion is performed under a constraint that the local display luminances associated with the at least two sub-pixel groups substantially corresponds to the corresponding local input luminances of input pixels. The result is that a display luminance pattern defined by the display pixels substantially matches an input luminance pattern defined by the corresponding input pixels. Consequently, luminance gradients in the original image are, as much as possible, reproduced on the display. The "as much as possible" indicates that it depends on the actual gradient (luminance and chrominance) in the input image whether it is possible to exactly reproduce this gradient in the output image. For example clipping may occur dependent on the luminance and chrominance of the input pixels of the input image.

It has to be noted that in the prior art sub-pixel rendering, the multi-primary conversion may be performed under a constraint such as an equal luminance constraint, but none of the prior art sub-pixel algorithms discloses the luminance gradient constraint.

In an embodiment, the constraint is determined by computing a first input luminance for input pixels associated with a first display area comprising the first sub-pixel group and the second sub-pixel group of the at least two sub-pixel groups. A second input luminance is computed for input pixels associated with a second display area comprising the first sub-pixel group and being a sub-area of the first display area. The constraint is determined to obtain a substantially matching ratio or difference between on the one hand the first input luminance and a the second input luminance and on the other hand a first display luminance which is the luminance of the sub-pixels covered by the first display area and a second display luminance which is the luminance of the sub-pixels covered by the second display area.

In an embodiment the first display area covers sub-pixels of all types to allow reproduction of any desired color. Thus, for example, in an RGBW display, the first area covers R, G, B and W sub-pixels. The second display area covers sub-pixel(s) allowing reproduction of any desired luminance but not any desired color. For example in an RGBW display, the second area covers the W sub-pixel or the RGB sub-pixels, or the G sub-pixel. It has to be noted that the second display area lies within the first display area. In this approach, the different luminance points of the multi-primary display are optimally used to reproduce the luminance gradients and resolution in the input image.

In an embodiment, the first input luminance is computed by using a first filtering operation with a first filter kernel which at least covers the first display area. Filter coefficients of the first filtering operation are proportional to areas of the sub-pixels which are covered by the first filter kernel. The second input luminance is computed by using a second filtering operation with a second filter kernel which covers the second display area. Filter coefficients of the second filtering operation are proportional to areas of the sub-pixels which are covered by the second filter kernel. The use of these filters, which take notice of the areas of sub-pixels covered, improves the correctness of the determination of the input luminances for the associated display areas. Consequently, the matching of the display intensity with the input intensity will be improved. Alternatively, the filter kernel may cover larger areas than the first and the second display area and thereby even partly overlap each other. The coefficients need not be exactly proportional to the areas of the sub-pixels covered.

In an embodiment, the computing of the first input luminance and the second luminance uses a filtering operation with a filter kernel covering the first display area minus the second display area. Filter coefficients of the filtering are proportional to areas of the sub-pixels being covered. This approach has the advantage that a single filter only is required.

In an embodiment, the determining of the constraint adds an equation to the multi-primary conversion defining the ratio or difference between the first display luminance and the second display luminance such that the ratio or difference, respectively, of the first input luminance and the second input luminance are matched. The addition of the equation to the multi-primary conversion is a simple method to perform the multi-primary conversion under the luminance gradient constraint.

In an embodiment, the conversion further comprising a sub-pixel distribution which determines local input luminances associated with sub-pixels covered by a region including and surrounding a particular one of the sub-pixels having a particular color. For example, in an RGBW display, the region may cover the W sub-pixel and parts of the surrounding RGB sub-pixels. Now, the local input luminances are the luminance of the W sub-pixel and the luminances of the covered parts of the RGB sub-pixels. The output image signal of the multi-primary conversion is for each sub-pixel distributed over the sub-pixels of the region to obtain a distributed image signal. The distribution is performed in accordance with the local input luminances associated with the sub-pixels covered by the region to obtain a luminance distribution across the sub-pixels which as much as possible matches the luminance distribution of the local input luminances. The distributed image signal is accumulated per sub-pixel for all sub-pixels in the region. Thus, now the local input luminances steer both the multi-primary conversion and the distribution of the output values of the multi-primary conversion over the sub-pixels to obtain an optimum correspondence between the luminance distribution on the display and the luminance distribution in the input image.

In an embodiment, the region is a display area comprising a first sub-pixel group and a second sub-pixel group of the at least two sub-pixel groups. Thus, the sub-pixel distribution may use the same local input luminances as required for determining the constraint for the multi-primary conversion.

In an embodiment, the determining of the local input luminances comprises computing a total luminance per particular color in the region by using a filtering operation with a filter kernel covering the region. Filter coefficients of the filtering are proportional to areas of the sub-pixels being covered by the filter kernel for the sub-pixels which have the particular color. Luminance contributions are determined for each one of the sub-pixels which are covered by the region and have the particular color by multiplying the total luminance with the relative area of a particular one of these sub-pixels in the region, and with the local input luminance of this particular one of the sub-pixels in the input image.

These and other aspects of the invention are apparent from and will be elucidated with reference to the embodiments described hereinafter.

It should be noted that items which have the same reference numbers in different Figures, have the same structural features and the same functions, or are the same signals. Where the function and/or structure of such an item has been explained, there is no necessity for repeated explanation thereof in the detailed description.

DETAILED DESCRIPTION

Figure 1:
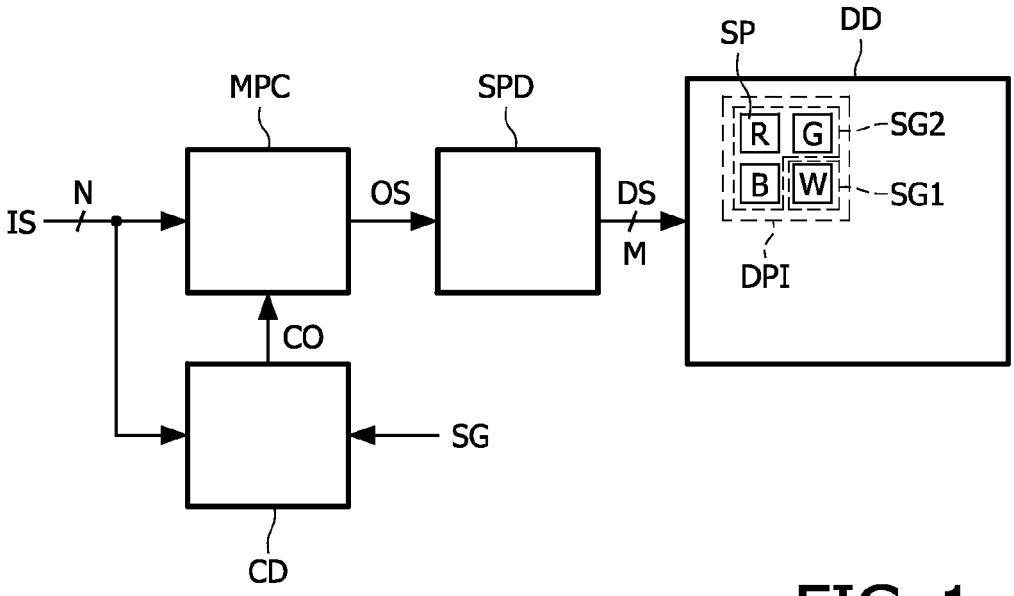
FIG. 1 schematically shows a block diagram of a converter for converting an input image signal defined with respect to N primaries into output signals for M>N primaries of a display device, FIGS. 2A and 2B schematically show an example of areas selected on the display device and the corresponding areas in the input image, respectively, for defining the constraint for the constrained multi-primary converter, FIGS. 3A to 3D schematically show another example of selected areas, FIG. 4 schematically shows a more detailed block diagram of an embodiment of the determination of the constraint and the constrained multi-primary conversion, FIG. 5 schematically shows a more detailed block diagram of another embodiment of the determination of the constraint, FIG. 6 schematically shows a block diagram of the sub-pixel distributor, and FIGS. 7A to 7C schematically show an example of the distribution of the output value for a green sub-pixel of an RGBW display.

FIG. 1 schematically shows a block diagram of a converter for converting an input image signal defined with respect to N primaries into an output signal for M>N display primaries. In the now following, this is elucidated for a display device DD which has per pixel DPI for each display primary a single sub-pixel SP.

The converter receives an input image signal IS which per input pixel is defined by N values defining the contribution of the N input primaries. Usually, the input signal is an RGB signal defined with respect to the three primaries R (red), G (green) and B (blue). Any other representation of the input signal, such as for example YUV can be converted into an RGB signal. Usually these RGB primaries are the EBU primaries. However, any other signal defined with respect to another number N of other primaries could also be processed.

The converter supplies M drive signals DS to the display device DD to drive the M sub-pixels SP of the display pixels DPI of the display device DD. In the example shown in FIG. 1, the display device DD is an RGBW display and the display pixel DPI comprises M=4 sub-pixels SP indicated by the color of the light (R, G, B and W (white)) contributed. The colors of the sub-pixels SP are also referred to as the display primaries. The display has more than one group of sub-pixels SP which are able to significantly contribute to the luminance of the display pixels DPI. In the example shown, one group SG1 contains the W sub-pixel, while another group SG2 contains the G sub-pixel or the RGB sub-pixels.

The converter comprises a multi-primary converter MPC which converts the input image signal IS defined with respect to the N input primaries into an output signal OS defined with respect to the display primaries. A sub-pixel distributor SPD distributes (or allocates) the output signal OS to the sub-pixels SP in the spatial surrounding of the output signal pixel being processed. For example, for an RGBW display, the input pixels which are defined by three values for the three input primaries RGB are converted into four drive values DS for the four sub-pixels SP. The multi-primary converter MPC receives a constraint CO which is generated by a constraint defining unit CD. The constraint defining unit CD uses area information A1, A2 or AD (see FIG. 2) which defines areas covering sub-pixels on the display DD. The constraint defining unit CD uses these areas to create a constraint CO such that the luminances of the areas as reproduced by the sub-pixels SP corresponds as much as possible to the luminances of input pixels of corresponding areas in the input image IS. The operation of the constraint defining unit CD will be discussed in more detail with respect to FIG. 2.

The sub-pixel distribution SPD may also use the input luminance distribution of the input pixels to steer the allocation of the output image signal OS of the multi-primary converter MPC to the drive values DS and thus the sub-pixels SP. This steered sub-pixel distribution SPD is described with respect to FIGS. 6 and 7.

Figure 2A:
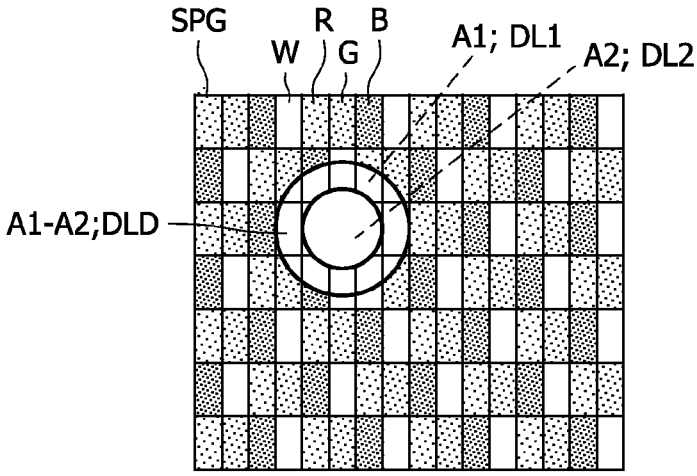
Figure 2B:
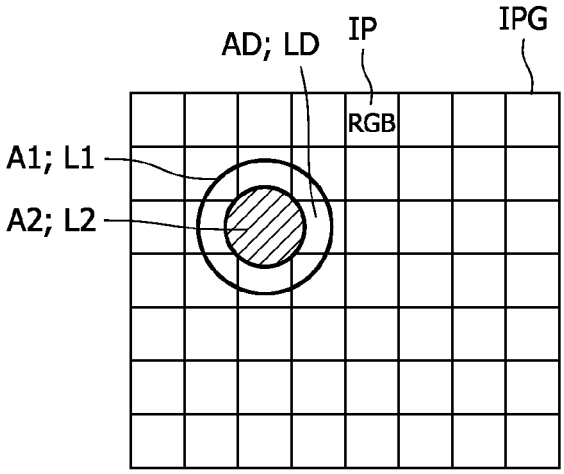

FIGS. 2A and 2B schematically show examples of areas selected on the display device and the corresponding areas in the input image, respectively, required for defining the constraint for the constrained multi-primary converter.

FIG. 2A shows an example of a sub-pixel grid SPG of a display device DD, which in the example shown is an RGBW display. Sub-pixels SP indicated by the same gray shade correspond to the same color. The area A1 is bound by the largest circle and covers the sub-pixels (or portions thereof) inside this largest circle. The area A2 is bound by the smallest circle and covers the sub-pixels (or portions thereof) inside this smallest circle.

The area or region A2 is selected to cover sufficient sub-pixels SP to obtain any desired luminance. In the example shown, the area A2 covers at least a portion of the RGB sub-pixels. If the W sub-pixel is selected as the central pixel, the area A2 may be selected to cover (a portion) of the W sub-pixel. Preferably, the area A2 is selected such that it is strongly related to a single luminance point of the display pixel DPI. In the RGBW display, two luminance points exist which convey high luminance information: the W sub-pixel and the RGB group of sub-pixels. Alternatively, the G sub-pixel alone may also be considered to be a high luminance point, however this luminance point has a color green which deviates from the color white of the other high luminance point. In an embodiment, strongly related, means that the area A2 covers as much as possible of a single high luminance point and as little as possible of the other luminance point(s). The area A1 is selected to cover all types of sub-pixels SP (or at least portions thereof) to obtain any desired color. Thus, the area A1 covers sufficient sub-pixels (or portions thereof) such that two high luminance points are covered. Preferably, the area A1 covers not more sub-pixels than required to cover a single combination of the two luminance points. One of the two luminance points within the area A1 is also within the area A2. Or said differently, the area A2 lies within the area A1. Although in the example shown the two areas A1 and A2 have a circular circumference any other suitable shape of the two areas A1, A2 may be selected.

FIG. 2B shows the input pixel grid IPG of input pixels of the input image signal IS. The area A2 is in the input pixel grid IPG centered on the input pixel corresponding to the sub-pixel group covered by the area A2 in the output sub-pixel grid SPG. The areas A1 and A2 of the input pixel grid IPG have the same relation with respect to each other as the areas A1 and A2 of the output sub-pixel grid SPG. The luminance L1 is the luminance of the input pixels (or covered portions thereof) within the area A1, and the luminance L2 is the luminance of the input pixels (or covered portions thereof) in the area A2.

The areas A1 and A2 are selected to be able to steer the multi-primary conversion MPC such that the luminances DL1, DL2 of the sub-pixels SP of the areas A1 and A2 in the output sub-pixel grid SPG, respectively, correspond as much as possible to the luminances L1 and L2 of the areas A1 and A2 in the input pixel grid IPG. Alternatively, instead of matching the two luminances L1 and L2, the luminance DLD in the output sub-pixel grid SPG of the area A2-A1, which is the area in the output sub-pixel grid SPG between the largest and the smallest circle, can be matched with the luminance LD of the corresponding area AD in the input pixel grid IPG. The areas A1 and A2 are shown to have the same dimensions in both the output sub-pixel grid SPG and the input pixel grid IPG because the input pixel grid IPG is scaled to fit the output sub-pixel grid SPG.

In an embodiment, the larger area A1 is selected with respect to the smaller area A2 to obtain a difference area AD or A1-A2 which covers the neighboring sub-pixels required to generate another luminance point than the luminance point related to the area A2. However, dependent on the sub-pixel pattern, the area A1 may comprise further sub-pixels or sub-pixel portions contributing to the luminance point covered by the area A2. In fact the difference in area between the areas A1 and A2 defines the area over which the luminance distributions created by the sub-pixels corresponds to the luminance distributions of the associated input pixels. With a small difference area less averaging occurs and high frequent spatial luminance distributions (or high luminance gradients) can be reproduced but only very locally. This very local approach may give rise to discontinuity artifacts for neighboring areas of the displayed image on the output sub-pixel grid SPG. With a relatively large difference area, discontinuity artifacts will be less but due to averaging of the luminance, luminance resolution will be lost.

FIGS. 3A to 3D schematically show another example of selected areas.

The example shown in FIG. 3A shows areas or sub-regions A1 and A2 in the sub-pixel grid SPG of the display screen of an RGBW display for the green and white and the green luminance points, respectively. This is effectively the closest neighborhood of the luminance point for white and green. The shape of the sub-regions A1 and A2 can, for example, be obtained from forming a Voronoi diagram of the luminance points. In the example shown in FIG. 3A, the sub-region or area A1 is bounded by the rectangle connecting the centre points of the green sub-pixels G1, G2, G3 and G4, and the sub-region or area A2 is bounded by the rectangle connecting the centre points of the red sub-pixels R1 and R2, and the blue sub-pixels B1 and B2. The white sub-pixel is indicated by W1.

FIG. 3B shows the associated input pixel luminances YG1, YR1, YG2, YB1, YW1, YB2, YG3, YR2 and YG4 in the input pixel grid IPG. Based on the selected sub-regions A1 and A2, the contributions for both determining the white luminance YW and the green luminance YG are shown in FIGS. 3C and 3D, respectively. It has to be noted that the sum of these contribution matrices forms the contribution matrix of the entire region. These contribution matrices are used to sample the luminance image, resulting in the desired luminance for the sets of green and white luminance points:

$$YW=YW1+\tfrac{1}{4}(YR1+YR2)+\tfrac{1}{4}(YB1+YB2)$$

$$YG=\tfrac{1}{4}(YG1+YG2+YG3+YG4)+\tfrac{1}{4}(YR1+YR2)+\tfrac{1}{4}(YB1+YB2)$$

It has to be noted that these contribution matrices, and the way they are used, are actually filter kernels which operate on the luminance input image. As shown, the filter kernels depend on the central sub-pixel. The kernels may take a wider region into account, or may add sharpening. The difference signal when the central sub-pixel is the white sub-pixel W1 is defined by:

$$\Delta Y=YW-YG=YW-\tfrac{1}{4}(YG1+YG2+YG3+YG4)$$

This difference signal is used as the constraint in the multi-primary conversion to effectively eliminate one degree of freedom.

The multi-primary conversion obeys the following general matrix equation wherein a color C=(Cx, Cy, Cz) when defined in the XYZ color coordinate system is determined by a linear combination of the drive values (RGBW):

$$\begin{bmatrix} Cx \\ Cy \\ Cz \end{bmatrix} = \begin{bmatrix} Rx & Gx & Bx & Wx \\ Ry & Gy & By & Wy \\ Rz & Gz & Bz & Wz \end{bmatrix} \cdot \begin{bmatrix} R \\ G \\ B \\ W \end{bmatrix}$$

In a practical implementation the normalized RGBW drive values are constrained to lie between 0.0 (full off) and 1.0 (full on). For example, in an analog implementation, these border values are usually related to the power supply voltages used, and in an digital implementation this range is the normalized range of digital words representable by the selected number of bits. In the central matrix, the columns (e.g. Rx Ry Rz) represent the color points of the individual primaries. The row Ry Gy By Wy represents the luminance of each of the display primaries. It has to be noted that this equation is under-determined and allows many solutions for the drive values R G B W that form the same target color C. This degree of freedom in solutions is used to steer the luminance towards green or white. In fact, it is tried to obtain the optimum luminance balance. This is achieved by adding two extra "constraint" rows, directly following from the above equations for YW and YG, to the matrix equation:

$$\begin{bmatrix} Cx \\ Cy \\ Cz \\ YW \\ YG \end{bmatrix} = \begin{bmatrix} Rx & Gx & Bx & Wx \\ Ry & Gy & By & Wy \\ Rz & Gz & Bz & Wz \\ 1/2Ry & 0 & 1/2By & Wy \\ 1/2Ry & Gy & 1/2By & 0 \end{bmatrix} \cdot \begin{bmatrix} R \\ G \\ B \\ W \end{bmatrix}$$

These constraint rows effectively force the drive values R G B W such that the desired luminance of the individual luminance point sub-regions YW, YG is achieved. Closer inspection reveals that the constraint rows 4 and 5 sum up to row 2. The above matrix is therefore of rank 4 which means that the matrix can be simplified by subtracting row 5 from row 4 (or the other way around):

$$\begin{bmatrix} Cx \\ Cy \\ Cz \\ \Delta Y \end{bmatrix} = \begin{bmatrix} Rx & Gx & Bx & Wx \\ Ry & Gy & By & Wy \\ Rz & Gz & Bz & Wz \\ 0 & -Gy & 0 & Wy \end{bmatrix} \cdot \begin{bmatrix} R \\ G \\ B \\ W \end{bmatrix}$$

This reveals the use of the luminance difference signal ΔY. The central matrix is static (its coefficients do not change), of full rank, and therefore its inverse can be computed and stored in the system. The inverse matrix is defined by:

$$Mxyz = \begin{bmatrix} Rx & Gx & Bx & Wx \\ Ry & Gy & By & Wy \\ Rz & Gz & Bz & Wz \\ 0 & -Gy & 0 & Wy \end{bmatrix}^{-1}$$

This inverse matrix is used to compute the optimal combination of drive levels Ro, Go, Bo, Wo:

$$\begin{bmatrix} Ro \\ Go \\ Bo \\ Wo \end{bmatrix} = Mxyz \cdot \begin{bmatrix} Cx \\ Cy \\ Cz \\ \Delta Y \end{bmatrix}$$

Similarly, a matrix RGB can be defined given by:

$$Mrgb = \begin{bmatrix} Rx & Gx & Bx & Wx \\ Ry & Gy & By & Wy \\ Rz & Gz & Bz & Wz \\ 0 & -Gy & 0 & Wy \end{bmatrix}^{-1} \cdot \begin{bmatrix} Rx & Gx & Bx & 0 \\ Ry & Gy & By & 0 \\ Rz & Gz & Bz & 0 \\ 0 & 0 & 0 & 1 \end{bmatrix}$$

Which performs a similar role as the XYZ matrix but now for input color C=(CR CG CB) defined directly in RGB. The computation for the optimal drive levels then becomes:

$$\begin{bmatrix} Ro \\ Go \\ Bo \\ Wo \end{bmatrix} = Mrgb \cdot \begin{bmatrix} CR \\ CG \\ CB \\ \Delta Y \end{bmatrix}$$

The optimal combination of drive values cannot always be realized on the actual display since they must lie in the valid range between 0.0 and 1.0. Usually, values outside the valid range are hard or soft clipped. An example of a circuit that performs a proper multi-primary conversion under a constraint for an optimal choice of drive values is described in WO2006/106457 (ID692833). The block diagram shown in FIG. 4 is based on this circuit.

Figure 4:
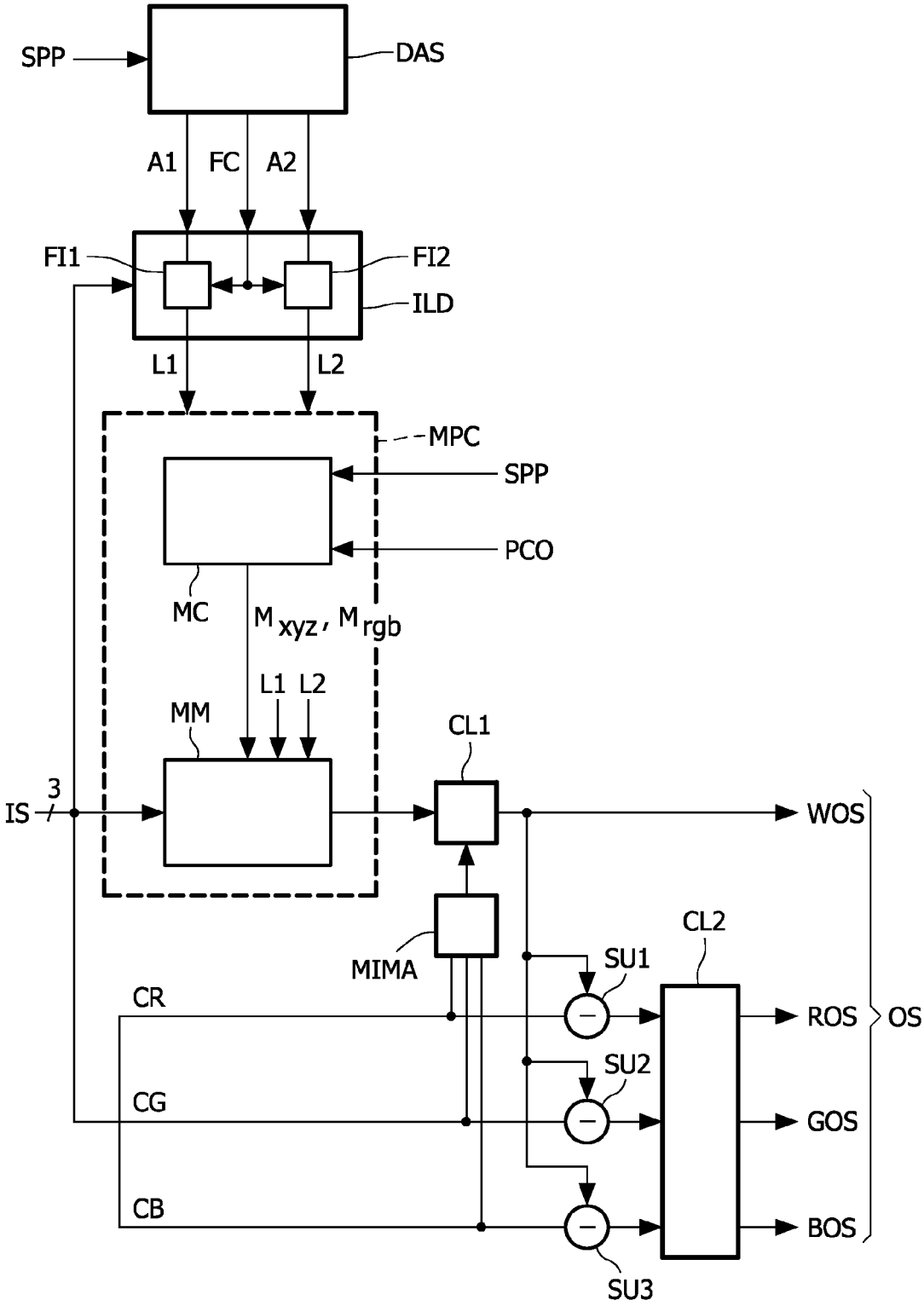

FIG. 4 schematically shows a more detailed block diagram of an embodiment of the determination of the constraint and the constrained multi-primary conversion.

The display area selector DAS selects, on the sub-pixel grid SPG of the display device DD, the area A1-A2 or areas A1, A2 on which the luminance constraint LC should be applied. The selection may depend on the actual sub-pixel pattern SPP. The display area selector DAS may actually receive input about the sub-pixel pattern SPP such that the area selection is tailored to the actual display. Alternatively, if the sub-pixel pattern SPP is well known, the areas A1, A2 selected may be pre-stored. The luminance constraint LC has to be related to the different sub-pixels groups which comprise differently colored sub-pixels having a contribution to the luminance. For example, in a RGBW display, the sub-pixels form a red, green, blue and white primary. The first group may comprise the white sub-pixel, the second group may comprise the green sub-pixel or the green, red and blue sub-pixels. It has to be noted that a selected sub-pixel group may comprise a single sub-pixel only.

The input luminance determining unit ILD determines the input luminance DL (see FIG. 5) or L1 and L2 of the input pixels IP in the input pixel grid IPG for input pixels IP (or portions thereof) which correspond to the area A1-A2 (see FIG. 5) or the areas A1 and A2, respectively, which areas were selected in the sub-pixel grid SPG. This input luminance DL or these input luminances L1 and L2 are used in the multi-primary conversion MPC to perform the conversion under the constraint CO that the corresponding display luminance or luminances of the area A1-A2 or the areas A1 and A2 match the input luminances DL or L1 and L2, respectively.

To determine the luminances L1 and L2, the input luminance determining unit ILD may comprise two filters FI1 and FI2 which filter the input pixels of the input image signal IS using the areas A1 and A2 as the filter kernels, respectively, and coefficients FC which depend on the relative area of portions of sub-pixels covered by the areas A1 and A2, respectively. A single filter FI (see FIG. 5) suffices if the delta luminance and the delta areas are used. Thus, the display area selector DAS may also be referred to as the kernel selector, and the input luminance determining unit ILD may be referred to as the filter.

Because a three to four multi-primary conversion MPC has a single freedom, one constraint CO can be applied. This single constraint CO may be defined as the ratio or as the difference between the two input luminances L1 and L2 of the two areas, or as a single luminance DL of a delta area A1-A2 of the two areas A1 and A2. The second area A2 may be selected to cover the first sub-pixel group SG1, the first area A1 may be selected to cover both the first sub-pixel group SG1 and the second sub-pixel group SG2. For example, in the RGBW display, the first sub-pixel group SG1 may comprise the white sub-pixel W, and the second area A2 comprises the white sub-pixel W and its immediate surrounding. This immediate surrounding may comprise the complete or part of the surrounding RGB sub-pixels. If part of a surrounding sub-pixel is covered, its contribution to the second luminance L2 defined in the input image is proportional to this part as may be defined by the filter coefficients FC.

The first area A1 comprises the second area A2 and its immediate surrounding sub-pixels. Again if an immediate surrounding sub-pixel is covered partly only, the contribution to the first luminance L1 defined in the input image is proportional to this part. Preferably, the second area A2, which may be called the centre area, is selected to cover sufficient sub-pixels to make any desired luminance, and the first area A1, which may be called the whole area, is selected to cover sub-pixels of all types to make any desired color. Or said differently, the second area A2 covers substantially a single luminance point, while the first area A1 covers this single luminance point and another (or parts of other) luminance point. Now, the luminances L1 and L2 in the input image corresponding to the two areas A1 and A2, respectively, are determined, and the multi-primary conversion MPC is steered such that the luminances DL1 and DL2 on the display in the two areas A1 and A2 match the luminances L1 and L2 in the input image in the two areas A1 and A2. Of course, instead of matching these two luminances L1 and L2, the luminance DL of the difference area A1-A2 may be matched.

It has to be noted that for a three to more than four primary multi-primary conversion MPC, more constraints CO may be added to obtain a deterministic solution. For example, in a display with five primaries, three luminance points per display pixel DPI can be defined, and two constraints CO can be defined to cancel the two degrees of freedom of the three to five multi-primary conversion MPC. Alternatively, only a subset of the degrees of freedom may be cancelled by using only a subset of the luminance constraints CO. Now, the remaining degrees of freedom may be left or may be used for another constraint.

The multi-primary conversion MPC comprises a matrix calculation unit MC which calculates the matrix Mxyz or Mrgb as described earlier by using the coordinates PCO of the display primaries, and the sub-pixel pattern (SPP) of the display (D1) to introduce the constraint CO as two extra equations or one extra equation, respectively (as has been elucidated before). The matrix multiplication unit MM multiplies (determines the inner product of) this matrix Mxyz or Mrgb with the pixel input values CR, CG, CB and the delta luminance to calculate the optimal drive value for the W sub-pixel in accordance with the already introduced equation:

$$\begin{bmatrix} Ro \\ Go \\ Bo \\ Wo \end{bmatrix} = Mrgb \cdot \begin{bmatrix} CR \\ CG \\ CB \\ \Delta Y \end{bmatrix}$$

As shown by this equation, also the optimal values Ro, Go, Bo for the red, green, blue sub-pixels could be calculated directly. However, FIG. 4 shows a more efficient approach which further takes care of clipping the drive values to the valid range which usually is normalized to the range 0 to 1 including the border values. In FIG. 4 the clipped optimal values are referred to as WOS, ROS, GOS and BOS for the W, R, G, B sub-pixel, respectively.

The min/max circuit MIMA determines the minimum and maximum bounds for valid values of the W drive signal. The min/max circuit MIMA controls the clipping circuit CL1 to clip any normalized negative values of Wo to zero and any normalized positive values larger than 1 to 1. Further, the valid values of Wo depend on the actual values of the Ro, Go, Bo values. The maximum value of Wo cannot be higher than the minimum value of the Ro, Go, Bo values, and the minimum value of Wo may be larger than zero if at least one of the Ro, Go, Bo values is larger than 1. The clipped value of Wo is the output value WOS for the W sub-pixel. The subtract circuits SU1, SU2 and SU3 subtract the clipped value WOS from the input values CR, CG and CB, respectively. The resulting difference signals are clipped in the clipping circuit CL2, if required, to supply the output signal OS of the multi-primary conversion of which the components are the output signals ROS, GOS and BOS for the R, G and B sub-pixels respectively.

The same scheme is valid for any other multi-primary system, however the multi-primary converter may become more complex, and an example is described in WO2006/106457.

Figure 5:
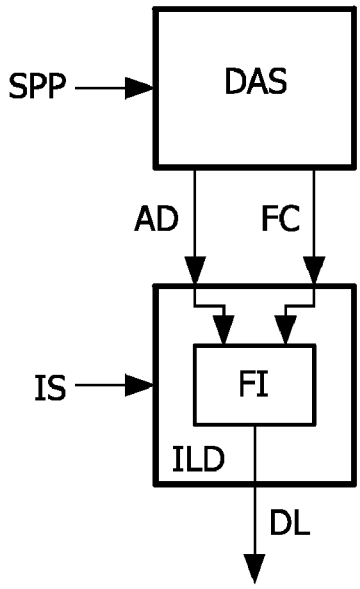

FIG. 5 schematically shows a more detailed block diagram of another embodiment of the determination of the constraint. In this embodiment a single filter FI is used to determine the delta luminance DL. Now the display area selector DAS selects, on the sub-pixel grid SPG of the display device DD, the delta area AD=A1-A2. The input luminance determining unit ILD determines the luminance DL of the contribution of input pixels of the input luminance signal IS for input pixels or input pixel portions within the delta area DA in the input pixel grid IPG. Now, the matrix calculation unit MC comprises the equation for the delta luminance ΔY as the constraint CO to the multi-primary conversion MPC matrix.

Figure 6:
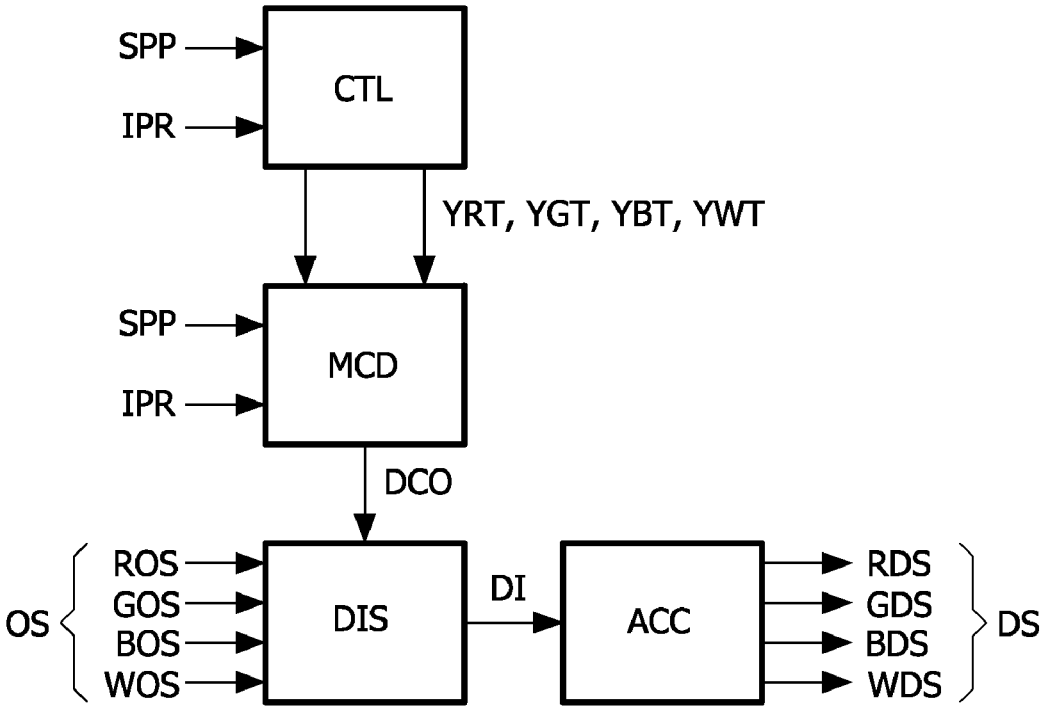

FIG. 6 schematically shows a block diagram of the sub-pixel distributor.

In general, in accordance with the invention the sub-pixel distributor distributes the output values ROS, GOS, BOS, WOS of the multi-primary conversion MPC over a sub-pixel region SPR surrounding and including the central sub-pixel which has a particular color. Dependent on the color of the central sub-pixel, such a sub-pixel region SPR may be selected, for example, to be the area A1 or A2, as shown in FIG. 3A. The central sub-pixel is the particular sub-pixel for which the output values are distributed. The distribution is not uniform in all directions but depends on the luminance gradient in the input image IS in an input image region IPR corresponding to the particular sub-pixel. Such a region of input pixels in the input image may be the area A1 or A2 as shown in FIG. 3B. Thus, the luminance of the region in the input image IPR which corresponds to the sub-pixel region SPR is used as a guide to distribute each one the output values ROS, GOS, BOS, WOS of each one of the sub-pixels in the sub-pixel region SPR.

In general, the distribution uses the rule that if one of the sub-pixels SP has a (relative) low associated luminance, it does not make sense to distribute a high drive value to it. Or said differently, if the input pixel luminance in the input image region IPR of the input pixel grid IPG at a particular position corresponding with the luminance point of the particular sub-pixel SP has a low value, a low drive value should be distributed to this particular sub-pixel SP. The sub-pixel distributor receives from the multi-primary converter MPC the sets of output values ROS, GOS, BOS, WOS for each sub-pixel SP. Further information is required on the sub-pixel pattern SPP of the above mentioned sub-pixel region SPR, which dictates to which primary colors the sub-pixels SP in the region belong, and on the desired luminance values in the input image region IPR surrounding the sub-pixel SP in question.

First, the circuit shown in FIG. 6 is briefly discussed. The operation of the circuit shown in FIG. 6 is described in more detail with respect to FIG. 7 for an example of the distribution of the GOS output value for the G sub-pixel.

The distributor DIS distributes the RGBW output values ROS, GOS, BOS, WOS supplied by the multi-primary converter MPC into the distributed signal D1 which is accumulated by the accumulating circuit ACC to obtain the drive signal DS. The drive signal DS has the components RDS, GDS, BDS and WDS for the RGBW sub-pixels SP, respectively. Each one of the RGBW output values ROS, GOS, BOS, WOS is distributed separately in accordance with distribution coefficients DCO such that the output value of a particular color is distributed over the drive signals DS for the sub-pixels SP of this particular primary color within the sub-pixel region SPR selected. The accumulating circuit ACC accumulates the computed RGBW regions SPR over the entire image. Each output value for a particular sub-pixel SP is partly distributed to the surrounding sub-pixels SP in the sub-pixel region SPR. This implies that each sub-pixel SP receives contributions for its own drive value from its neighbors. These contributions are summed by the accumulator ACC and, if required clipped (not shown) to the valid range to obtain de drive signal DS for this sub-pixel SP.

The total luminance computing circuit CTL computes the total luminance YRT, YGT, YBT, YWT for each one of the primaries R, G, B, W, respectively, by using the luminance distribution in the input pixel region IPR of FIG. 3B. The total luminance computing circuit CTL retrieves the position of the differently colored sub-pixels SP of the display DD from the sub-pixel region SPR which provides the sub-pixel pattern SPP in this region SPR. The sub-pixel patters SPP may be identical to the sub-pixel pattern shown in FIG. 3A. As with respect to FIG. 3 the input pixel region IPR and the sub-pixel region SPR have a one to one relation.

The multiplication coefficient determiner MCD determines the multiplication coefficients MCO for each sub-pixel SP which has a particular color as a luminance contribution of the sub-pixel SP in question in comparison to the total luminance of the sub-pixels SP which have the particular color. This ratio of the luminance contribution of the sub-pixel SP in question and the total luminance is defined by (i) the area contribution of the sub-pixel SP in question to the total area of the sub-pixels SP having this color in the selected area A1 or A2, see also FIGS. 3A and 3B, and (ii) by the luminance pattern IPR in the input image IS as shown in FIG. 3B. Consequently, the multiplication coefficient determiner MCD needs to receive the total luminance YRT, YGT, YBT, YWT, the luminance pattern IPR and the sub-pixel pattern SPP. The area ratios are defined by the areas of, portions of, sub-pixels SP in the regions A1 and A2.

Figure 7A:
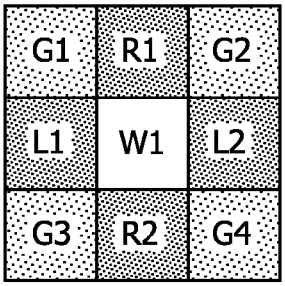
Figure 7B:
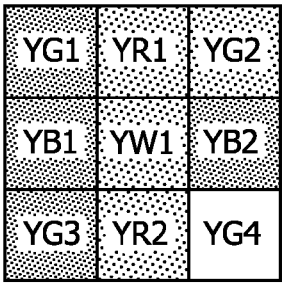
Figure 7C:
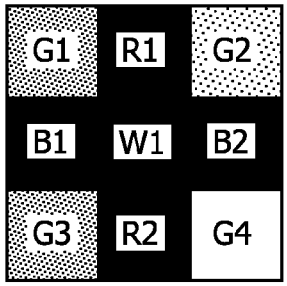

FIGS. 7A to 7C schematically show an example of the distribution of the output value for a green sub-pixel of an RGBW display.

FIG. 7A shows the selected sub-pixel region SPR wherein the color of the sub-pixels SP is indicated by the capital letters and the numbers are identifying the sub-pixels SP which have the same color. In the example shown, G1 to G4 indicate the green sub-pixels, R1 and R2 the red sub-pixels, B1 and B2 the blue sub-pixels and W1 the central white sub-pixel.

FIG. 7B shows the input pixel region IPR corresponding to the selected sub-pixel region SPR. The local luminances YL of the input pixels are indicated linked to the color of the sub-pixels in the sub-pixel region SPR. The local luminances YL of the input pixels IP corresponding with the green sub-pixels G1 to G4 are YG1 to YG4, the luminances of the input pixels corresponding with the red sub-pixels R1 and R2 are YR1 and YR2, the luminances of the input pixels corresponding with the blue sub-pixels B1 and B2 are YB1 and YB2 and finally, the luminance of the input pixel corresponding with the white sub-pixel W1 is YW1.

FIG. 7C shows grey levels indicating how the output value of the multi-primary conversion MPC for the green sub-pixels G1 to G4 in the region around the central pixel W1 are distributed over, or allocated to, these green sub-pixels G1 to G4. As can be seen from FIGS. 7B and 7C, the total luminance YT for the green sub-pixels in the input pixel region IPR is distributed over the green sub-pixels G1 to G4 in accordance with the luminance distribution YG1 to YG4 over the separate input pixels associated with the green sub-pixels G1 to G4 such that the luminances GDS1 to GDS4 result.

Said in other words, for the distribution of the green G drive value, first the locations of the green sub-pixels G1 to G4 are determined within the sub-pixel region SPR. Secondly, the corresponding desired luminances YG1 to YG4 are retrieved. The drive value GDS for the G sub-pixel is then distributed proportionally to these luminances. To compute the distribution proportion, first the total luminance YT for the green sub-pixels G1 to G4 is computed, and weighted by the contribution coefficients (for example, as already defined for the multi-primary conversion MPC, see FIG. 3C) for the green sub-pixels G1 to G4 in the region SPR. The total luminance is defined by:

$$YGT=\tfrac{1}{4}(YG1+YG2+YG3+YG4)$$

It has to be noted that for this particular embodiment of the RGBW quad layout, all coefficients are equal to ¼. This is, however not the case for other layouts, such as for example the RGBW pentile layout. The weighting can be used to create preference for closer located sub-pixels to further away located sub-pixels. It is advisable to keep the distributed color as close as possible to the central sub-pixel. The weighting can again be seen as a filter kernel, per display primary, which also varies with the central sub-pixel.

The distribution to the green sub-pixels G1 to G4 is then computed according to:

$$GDS1 = GOS\cdot\left(\frac{1/4\cdot YG1}{YT}\right)$$

$$GDS2 = GOS\cdot\left(\frac{1/4\cdot YG2}{YT}\right)$$

$$GDS3 = GOS\cdot\left(\frac{1/4\cdot YG3}{YT}\right)$$

$$GDS4 = GOS\cdot\left(\frac{1/4\cdot YG4}{YT}\right)$$

According to this distribution, the entire drive value GOS is completely distributed:

$$GOS=GDS1+GDS2+GDS3+GDS4$$

The same process is then followed for the other primary drive values WOS, ROS and BOS.

It has to be noted that the preceding embodiment is a guideline only, and that the distribution should be substantially proportional to the luminance distribution YL. Any comparable scheme could suffice. In the extreme case of, for example, only one of the green sub-pixels (e.g. the G4 sub-pixel with the luminance YG4) has some luminance, and the remainder being completely dark, then all of the drive value GOS is passed on to only that particular green sub-pixel G4. This level of distribution is then most likely to result in clipping for that sub-pixel G4. This can be avoided if constraints are put on the range of the distribution factors $$\left(\frac{1/4\cdot YGn}{YT}\right).$$

It should be noted that the above-mentioned embodiments illustrate rather than limit the invention, and that those skilled in the art will be able to design many alternative embodiments without departing from the scope of the appended claims.

Although the present invention is elucidated in many embodiments for an RGBW display, a similar approach is valid for other multi-primary displays. Further, the sub-pixel pattern shown are examples only, the present invention is applicable on any sub-pixel pattern which is able to create more than one luminance point.

Although the present invention is elucidated by describing functions of hardware blocks, instead of dedicated hardware a suitably programmed computer may be used to perform the functions. The program code may be available on a computer program product, or may be implemented as a plug-in in a software application.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method of converting an input image signal into a drive signal for driving sub-pixels of a display device comprising display pixels having at least two sub-pixel groups being able to contribute to luminance information displayed, the conversion comprising:

a multi-primary conversion for receiving the input image signal and being performed under a constraint, and first determining the constraint by substantially matching local display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels; and, wherein the first determining the constraint comprises:

selecting a first display area comprising a first sub-pixel group and a second sub-pixel group of the at least two sub-pixel groups, and a second display area comprising the first sub-pixel group and being a sub-area of the first display area, computing a first input luminance for input pixels associated with the first display area, computing a second input luminance for input pixels associated with the second display area, and second determining the constraint to obtain a substantially matching ratio or difference between on the one hand the first input luminance and the second input luminance and on the other hand a first display luminance being the luminance of the sub-pixels covered by the first display area and a second display luminance being the luminance of the sub-pixels covered by the second display area.

2. A method as claimed in claim 1, wherein the first display area covers sub-pixels of all types to allow reproduction of any desired color.

3. A method as claimed in claim 1, wherein the determining the constraint adds an equation to the multi-primary conversion defining the ratio or difference between the first display luminance and the second display luminance substantially matching the ratio or difference, respectively, of the first input luminance and the second input luminance.

4. A method as claimed in claim 1, further comprising a matrix multiplication for multiplying the input signal with a matrix to obtain an output signal of the multi-primary conversion, the matrix being defined by the coordinates of primaries associated with the sub-pixels and the sub-pixel pattern of the display and including the constraint.

5. A method as claimed in claim 1, further comprising determining local input luminances associated with sub-pixels covered by a sub-pixel region including and surrounding a particular one of the sub-pixels having a particular color to Obtain an output signal of the multi-primary conversion, distributing the output image signal of the multi-primary, conversion of the sub-pixel over the sub-pixels of the sub-pixel region to obtain a distributed image signal, the distributing being performed in accordance with the local input luminances associated with the sub-pixels covered by the sub-pixel region, to obtain a luminance distribution across the sub-pixels corresponding to the luminance distribution of the local input luminances, and accumulating the distributed image signal per sub-pixel for all sub-pixels in the region to obtain the drive signals for the sub-pixels.

6. A method as claimed in claim 5, wherein the sub-pixel region is a display area comprising a first sub-pixel group and a second sub-pixel group of the at least two sub-pixel groups.

7. A computer program product comprising code stored in a non-transitory computer readable medium, said code enabling a processor to execute the steps of the method as claimed in claim 1, the steps being:

a multiple-primary conversion for receiving the input image signal and being performed under a constraint, and first determining the constraint by substantially matching local display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels; and, wherein the first determining the constraint comprises:

selecting a first display area comprising a first sub-pixel group and a second sub-pixel group of the at least two sub-pixel groups, and a second display area comprising the first sub-pixel group and being a sub-area of the first display area, computing a first input luminance for input pixels associated with the first display area, computing a second input luminance for input pixels associated with the second display area, and second determining the constraint to obtain a substantially matching ratio or difference between on the one hand the first input luminance and the second input luminance and on the other hand a first display luminance being the luminance of the sub-pixels covered by the first display area and a second display luminance being the luminance of the sub-pixels covered by the second display area.

8. A method of converting an input image signal into a drive signal for driving sub-pixels of a display device comprising display pixels having at least two sub-pixel groups being able to contribute to luminance information displayed, the conversion comprising:

a multi-primary conversion for receiving the input image signal and being performed under a constraint, and first determining the constraint by substantially matching local. display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels;

wherein the first determining the constraint comprises:

selecting a first display area comprising a first sub-pixel group and a second sub-pixel group of the at least two sub-pixel groups, and a second display area comprising the first sub-pixel group and being a sub-area of the first display area, computing a first input luminance for input pixels associated with the first display area, computing a second input luminance for input pixels associated with the second display area, and second determining the constraint to obtain a substantially matching ratio or difference between on the one hand the first input luminance and the second input luminance and on the other hand a first display luminance being the luminance of the sub-pixels covered by the first display area and a second display luminance being the luminance of the sub-pixels covered by the second display area; and, the computing the first input luminance uses a first filtering operation with a first filter kernel at least covering the first display area, first filter coefficients of the first filtering are proportional to areas of the sub-pixels being covered by the first filter kernel, the computing the second input luminance comprises a second filtering operation with a second filter kernel covering the second display area, second filter coefficients of the second filtering are proportional to areas of the sub-pixels being covered by the second filter kernel.

9. A method of converting an input image signal into a drive signal for driving sub-pixels of a display device comprising display pixels having at least two sub-pixel groups being able to contribute to luminance information displayed, the conversion comprising:

a multi-primary conversion for receiving the input image signal and being performed under a constraint, and first determining the constraint by substantially matching local display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels;

wherein the first determining the constraint comprises:

selecting a first display area comprising a first sub-pixel group and a second sub-pixel group of the at least two sub-pixel groups, and a second display area comprising the first sub-pixel group and being a sub-area of the first display area, computing a first input luminance for input pixels associated with the first display area, computing a second input luminance for input pixels associated with the second display area, and second determining the constraint to obtain a substantially matching ratio or difference between on the one hand the first input luminance and the second input luminance and on the other hand a first display luminance being the luminance of the sub-pixels covered by the first display area and a second display luminance being the luminance of the sub-pixels covered by the second display area; and, the computing the first input luminance and the second input luminance uses a filtering operation with a filter kernel covering a delta area of the first display area and the second display area, filter coefficients of the filtering are proportional to areas of the sub-pixels being covered by the delta area.

10. A method of converting an input image signal into a drive signal for driving sub-pixels of a display device comprising display pixels having at least two sub-pixel groups being able to contribute to luminance information displayed, the conversion comprising:

a multi-primary conversion for receiving the input image signal and being performed under a constraint, first determining the constraint by substantially matching local display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels;

second determining local input luminances associated with sub-pixels covered by a sub-pixel region including and surrounding a particular one of the sub-pixels having a particular color to obtain an output signal of the multi-primary conversion, distributing the output image signal of the multi-primary conversion of the sub-pixel over the sub-pixels of the sub-pixel region to obtain a distributed image signal, the distributing being performed in accordance with the local input luminances associated with the sub-pixels covered by the sub-pixel region, to obtain a luminance distribution across the sub-pixels corresponding to the luminance distribution of the local input luminances, accumulating the distributed image signal per sub-pixels for all sub-pixels in the region to obtain the drive signals DS for the sub-pixels;

wherein the second determining local input luminances comprises computing a total luminance per particular display primary associated with a particular one of the sub-pixels by using a filtering operation with a filter kernel covering an input pixel region corresponding to the sub-pixel region, wherein filter coefficients of the filtering are proportional to areas of the sub-pixels being covered by the filter kernel and being associated with a particular color of the particular one of the sub-pixels, and third determining luminance contributions for each one of the sub-pixels covered by the sub-pixel region and having the particular color by multiplying the total luminance with the relative area of a particular one of these sub-pixels in the sub-pixel region and with the local input luminance of this particular one of the sub-pixels in the input image.

11. A conversion unit for converting an input image signal into a drive signal for driving sub-pixels of a display device comprising display pixels having at least two sub-pixel groups being able to contribute to luminance information displayed, the conversion unit comprises:

a multi-primary converter for receiving the input image signal and being performed under a constraint, and a constraint determining unit for determining the constraint by substantially matching local display luminances associated with the at least two sub-pixel groups with corresponding local input luminances of input pixels of the input image signal, thereby obtaining a display luminance pattern defined by the display pixels corresponding to an input luminance pattern defined by the input pixels associated with the display pixels; and, wherein the determining the constraint comprises:

selecting a first display area comprising a first sub-pixel group and a second sub-pixel group of the at least two sub-pixel groups, and a second display area comprising the first sub-pixel group and being a sub-area of the first display area, computing a first input luminance for input pixels associated with the first display area, computing a second input luminance for input pixels associated with the second display area, and determining the constraint to obtain a substantially matching ratio or difference between on the one hand the first input luminance and the second input luminance and on the other hand a first display luminance being the luminance of the sub-pixels covered by the first display area and a second display luminance being the luminance of the sub-pixels covered by the second display area.

* * * * *